US008847097B2

(12) United States Patent
Renz et al.

(10) Patent No.: US 8,847,097 B2
(45) Date of Patent: Sep. 30, 2014

(54) VACUUM INTERRUPTER

(75) Inventors: Roman Renz, Berlin (DE); Ulf Schümann, Dallgow-Döberitz (DE); Astrid Renz, legal representative, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 411 days.

(21) Appl. No.: 13/382,602

(22) PCT Filed: Jun. 18, 2010

(86) PCT No.: PCT/EP2010/058632

§ 371 (c)(1), (2), (4) Date: Jun. 14, 2012

(87) PCT Pub. No.: WO2011/003719

PCT Pub. Date: Jan. 13, 2011

(65) Prior Publication Data

US 2013/0062316 A1 Mar. 14, 2013

(30) Foreign Application Priority Data

Jul. 6, 2009 (DE) ..... 10 2009 031 598

(51) Int. Cl.
*H01H 33/66* (2006.01)
*H01H 33/662* (2006.01)

(52) U.S. Cl.
CPC ..... *H01H 33/66261* (2013.01); *H01H 2033/66292* (2013.01); *H01H 2033/66284* (2013.01)
USPC ..... 218/136

(58) Field of Classification Search
CPC ..... H01H 2033/6623
USPC ..... 218/136–139
See application file for complete search history.

(56) References Cited

U.S. PATENT DOCUMENTS 2,892,912 A * 6/1959 Greenwood et al. ..... 218/136
3,185,799 A * 5/1965 Greenwood et al. ..... 218/123
3,185,800 A * 5/1965 Titus ..... 218/136
3,222,484 A 12/1965 Jennings (Continued)

FOREIGN PATENT DOCUMENTS

CN 1432183 A 7/2003
CN 101208763 A 6/2008

(Continued)

OTHER PUBLICATIONS

German Patent and Trademark Office, Office Action Dated Mar. 1, 2010.

*Primary Examiner* — Truc Nguyen
(74) *Attorney, Agent, or Firm* — Laurence A. Greenberg; Werner H. Stemer; Ralph E. Locher

(57) ABSTRACT

A vacuum interrupter includes a housing having two insulating material areas disposed and constructed symmetrically with respect to a center plane. Each of the two insulating material housing areas includes a plurality of insulating material housing parts. The interrupter has a compact construction and high dielectric strength. The insulating material housing part of each insulating material housing area located farthest away from the center plane has a length that is greater than the length of the other insulating material housing parts.

4 Claims, 1 Drawing Sheet

(56) References Cited

U.S. PATENT DOCUMENTS

| | | | | | |
|---|---|---|---|---|---|
| 3,766,345 | A | * | 10/1973 | Attia | 218/136 |
| 3,792,214 | A | * | 2/1974 | Voshall | 218/136 |
| 3,903,386 | A | | 9/1975 | Yanagisawa | |
| 4,006,331 | A | * | 2/1977 | Crouch | 218/136 |
| 4,088,860 | A | * | 5/1978 | Abe et al. | 218/136 |
| 5,793,008 | A | * | 8/1998 | Mayo et al. | 218/129 |
| 6,218,627 | B1 | * | 4/2001 | Shindo et al. | 174/167 |
| 6,720,515 | B2 | * | 4/2004 | Renz et al. | 218/136 |
| 6,891,122 | B2 | * | 5/2005 | Renz | 218/136 |
| 2009/0095718 | A1 | | 4/2009 | Schellekens et al. | |

FOREIGN PATENT DOCUMENTS

| | | | |
|---|---|---|---|
| CN | 101238533 | A | 8/2008 |
| DE | 101 57 140 | A1 | 5/2003 |
| DE | 100 29 763 | B4 | 1/2009 |
| EP | 1 897 107 | A1 | 3/2008 |
| JP | 5582738 | U | 6/1980 |
| JP | 55082738 | A | 6/1980 |
| SU | 1081696 | A | 3/1984 |
| WO | 01/97242 | A1 | 12/2001 |
| WO | 2007/003727 | A1 | 1/2007 |
| WO | 2007016882 | A1 | 2/2007 |

* cited by examiner

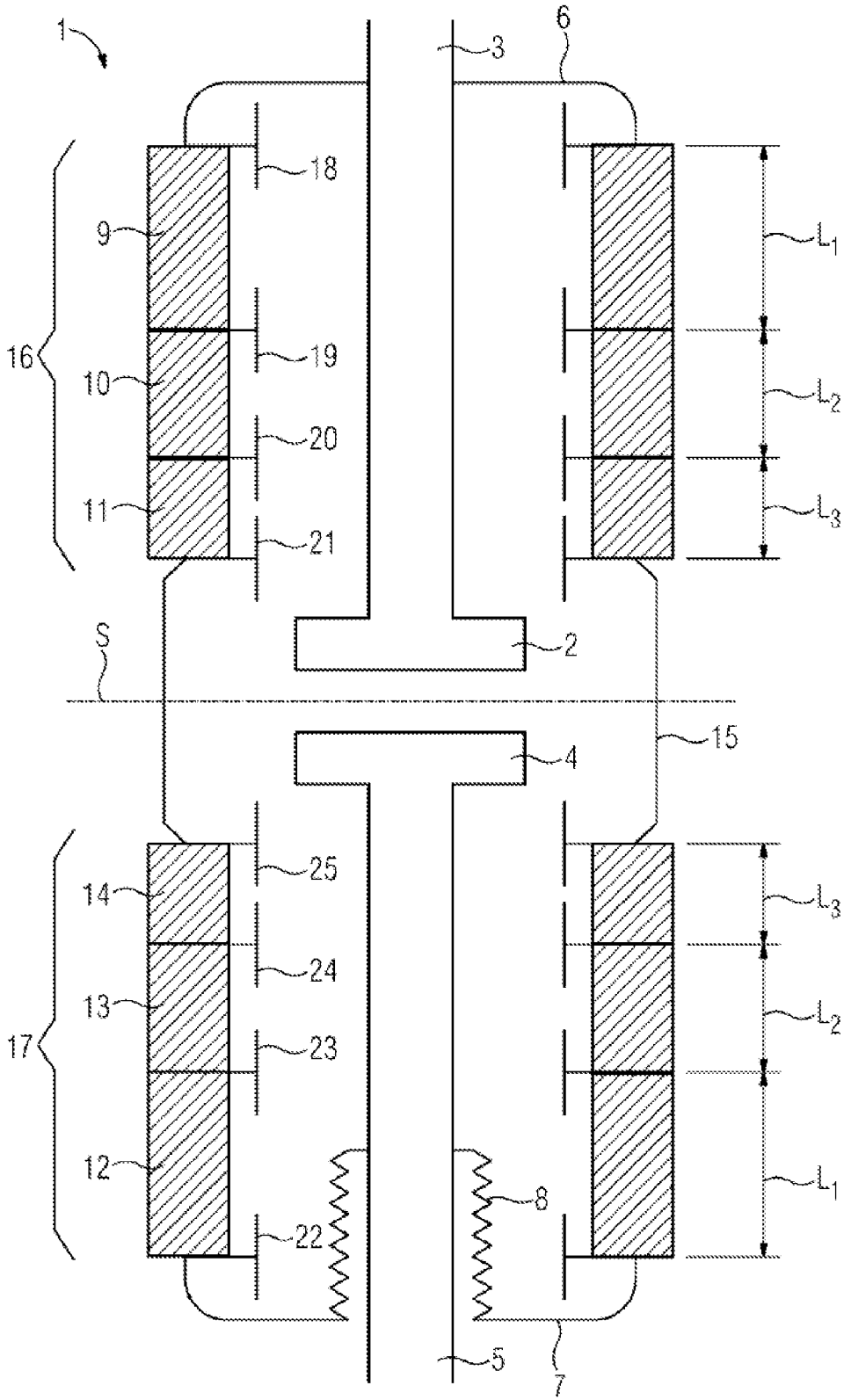
1
3
6
18
9
L1
16
19
10
L2
20
11
L3
21
S
2
15
4
25
14
L3
24
13
L2
17
23
12
L1
8
22
5
7

VACUUM INTERRUPTER

BACKGROUND OF THE INVENTION

Field of the Invention

The invention relates to a vacuum interrupter having a housing which has two insulating material housing areas which are arranged and formed symmetrically with respect to a center plane, with each of the two insulating material housing areas comprising a plurality of insulating material housing parts.

A vacuum interrupter such as this is known from DE 10029763B4. The vacuum circuit disclosed there has a housing which has two insulating material housing areas which are arranged and formed symmetrically with respect to a center plane. Each of the two insulating material housing areas in this case comprises a plurality of insulating material housing parts, and in the case of DE 10029763B4 two insulating material housing parts are provided in the form of ceramic cylinders for each of the two insulating material housing areas. The length of the individual insulating material housing parts is in this case governed by a maximum dielectric load on the vacuum interrupter corresponding to the rated voltage for which the vacuum interrupter is designed, and depending on the internal geometry of the vacuum interrupter and capacitive couplings to external items, for example a grounded housing of a circuit breaker in which the vacuum interrupter is used. The length of the individual insulating material housing parts is in this case designed such that the vacuum interrupter has the required flashover resistance.

BRIEF SUMMARY OF THE INVENTION

The object of the present invention is to develop a vacuum interrupter of the type mentioned initially, which is of compact design with high dielectric strength.

According to the invention, in the case of a vacuum interrupter of the type mentioned initially, this is achieved in that that insulating material housing part of each insulating material housing area which is arranged furthest away from the center plane has a length which is greater than the length of the further insulating material housing parts.

A greater length of those insulating material housing parts of each insulating material housing area of the vacuum interrupter which are arranged furthest away from the center plane is advantageous because, from experience, a potential distribution which occurs over the vacuum interrupter in the axial direction is not distributed linearly over the vacuum interrupter, but those insulating material housing parts which are arranged furthest away from the center plane are subject to the greatest load. This is because potential differences on each insulating material housing part increase continuously from one end of the vacuum interrupter to the other end of the vacuum interrupter, as a result of which the last insulating material housing part is subject to the greatest load. In alternating-current systems, the polarity of the potentials which are present on the tube furthermore changes, as a result of which the two insulating material housing parts which are arranged furthest away from the center plane of the vacuum interrupter are alternately subject to the greatest loads. The length of these insulating material housing parts which are arranged furthest away from the center plane is therefore governed by the required dielectric strength or flashover resistance for which the vacuum interrupter should be suitable. Further insulating material housing parts which are closer to the center plane of the vacuum interrupter are subject to less dielectric loading and can in consequence have a shorter length, as a result of which a vacuum interrupter designed in this way allows a compact design while the dielectric strength of the vacuum interrupter remains high and constant. For the purposes of the present invention, the center plane is in this case a plane which runs at right angles to the longitudinal axis of the vacuum interrupter, and with respect to which the housing of the vacuum interrupter is designed to be essentially symmetrical, with the housing having metallic cover parts in addition to the insulating material housing parts, in a form which is known for vacuum interrupters and by means of which contact connections for a fixed contact and moving contact of the vacuum interrupter extend in a vacuum-tight manner through into the interior of the vacuum interrupter. The insulating material housing parts are advantageously in the form of ceramic cylinders.

In one advantageous embodiment of the invention, the further insulating material housing parts have a decreasing length as the distance from the center plane decreases. A decrease in the length of the further insulating material housing parts in this way leads in a simple manner to a further compact design of the vacuum interrupter with high dielectric strength, because the dielectric loads decrease as the distance from the center plane of the vacuum interrupter decreases, as a result of which the requirements for the length of the insulating material housing parts likewise become less.

In one particularly advantageous embodiment of the invention, the lengths of the further insulating material housing parts are calculated from the length of the insulating material housing part which is arranged furthest away, using $$L(x) \geq p(x) \cdot L_N$$

where $$p(x) \cong \frac{(2x-1)}{(2N-1)}$$

and N=the total number of insulating material housing parts of the vacuum interrupter
and x=N, $$N-1 \ldots \frac{N}{2}+1.$$

Such setting of the length of the further insulating material housing by calculation from the length of the insulating material housing part which is arranged furthest away has, in a multiplicity of experiments and trials, been found to be the best possible setting for the length of the further insulating material housing parts as a function of the length of the insulating material housing part which is arranged furthest away, by which means the requirements for dielectric strength and compactness of the vacuum interrupter are satisfied as well as possible.

In a further refinement of the invention, vapor shields and/or field control elements are mounted between the insulating material housing parts. Such vapor shields and field control elements which are mounted between the insulating material housing parts and are arranged in the interior of the vacuum interrupter ensure in a simple manner that the insulating material housing parts are shielded from vaporization caused by metal vapors that are created during the switching process.

In a further preferred embodiment of the invention, a metallic housing part is provided between the insulating material housing areas. A metallic housing part such as this is likewise advantageous for increasing the flashover resistance of a vacuum interrupter.

BRIEF DESCRIPTION OF THE SINGLE VIEW OF THE DRAWING

The invention will be explained in more detail in the following text using one exemplary embodiment and with reference to the drawing, whose single FIGURE shows a schematic cross-sectional view of a vacuum interrupter according to the invention.

DESCRIPTION OF THE INVENTION

The FIGURE shows a vacuum interrupter 1 with a fixed contact 2 and a fixed contact connecting bolt 3, as well as a moving contact 4 and a moving contact connecting bolt 5. The fixed contact connecting bolt 3 is in this case passed out in a vacuum-tight manner through a first metallic cover part 6 of the vacuum interrupter, and the moving contact connecting bolt 5 is passed out of the vacuum interrupter in a vacuum-tight manner through a second metallic cover part 7, by means of a bellows 8 allowing it to move, as a result of which the contact system is formed from the fixed contact 2 and the moving contact 4 for switching a current which is carried via the fixed contact and moving contact connecting bolts 3 and 5, for example for a circuit breaker, in which a drive movement of a drive unit, which is not illustrated in the FIGURE, can be introduced into the moving contact connecting bolt 5 in order to close or open the contact system comprising the fixed contact 2 and the moving contact 4. The vacuum interrupter 1 furthermore has housing components in the form of insulating material housing parts 9, 10, 11, 12, 13 and 14, which are in the form of ceramic cylinders, with a metallic housing part 15 being provided between the insulating material housing parts 11 and 14 in the exemplary embodiment, which metallic housing part 15 is arranged in the area of the contact system comprising the fixed contact 2 and the moving contact 4. The housing of the vacuum interrupter 1 is arranged and formed essentially symmetrically with respect to a center plane S, with the insulating material housing parts 9, 10 and 11 forming a first insulating material housing area 16, and the insulating material housing parts 12, 13 and 14 forming a second insulating material housing area 17, in other words such that the insulating material housing areas 16 and 17 are arranged and formed symmetrically with respect to the center plane S. For the purposes of the exemplary embodiment, symmetrically in this case means that the insulating material housing parts 9 and 12 have the same length $L_1$, the insulating material housing parts 10 and 13 have the same length $L_2$, and the insulating material housing parts 11 and 14 have the same length $L_3$, and the insulating material housing areas 16 and 17 are at the same distance from the center plane S. In this case, vapor shields and/or field control elements 18 to 25, which are provided in the interior of the vacuum interrupter 1, are arranged and mounted in a vacuum-tight manner between two adjacent insulating material housing parts and at the boundary areas between insulating material housing parts and the first and second metallic cover parts 6 and 7. The vapor shields and/or field control elements 18 to 25 are used for shielding the insulating material housing parts against metal vapors which are created by erosion of the contacts during a switching process from acting on them.

A vacuum interrupter illustrated as in the exemplary embodiment in an alternating-current system is subject to a potential being set in the axial direction, with the potential distribution increasing from one interrupter end to the other end, as a result of which the last ceramic is most severely loaded. Depending on the polarity, in the case of the vacuum interrupter 1, this is the insulating material housing part 9 or 12 which, in consequence, have the greatest length $L_1$, since these are the insulating material housing parts of each insulating material housing area which are arranged furthest away from the center plane. The length $L_1$ is therefore determined from the requirements for the dielectric strength of the vacuum interrupter and the rated voltage, as well as the external factors such as capacitive couplings to a grounded housing of a surrounding circuit breaker. The length $L_2$ or $L_3$ of the respective insulating material housing parts 10 and 13 as well as 11 and 14 is determined from the length $L_1$ of the insulating material housing parts 9 and 12 using the formula:

$$L(x) \geq p(x) \cdot L_N,$$

where N is the number of ceramics, 6 in the case of the exemplary embodiment, and where p(x) is a scaling factor which is determined from:

$p(x) \cdot \approx (2x-1)/(2N-1)$, where x can assume the values N, $$N-1 \ldots \frac{N}{2}+1$$

such that, in the exemplary embodiment shown the FIGURE for N=6, x can for symmetry reasons assume the values 6, 5 and 4, and the lengths of the insulating material housing parts 9 and 12 as well as 10 and 13 and 11 and 14 are respectively likewise of the same magnitude for symmetry reasons with respect to the center plane S, in which case the scaling factor is: $p(6)=1-p(1)$ and $$p(5) = p(2) = \frac{9}{11}$$

and $$p(4) = p(3) = \frac{5}{11}.$$

Based on the formula defined above, this therefore results in the length $L_2=0.81*L_1$, and the length $L_3=0.45*L_1$.

LIST OF REFERENCE SYMBOLS

1 Vacuum interrupter
2 Fixed contact
3 Fixed contact connecting bolt
4 Moving contact
5 Moving contact connecting bolt
6 First metallic cover part
7 Second metallic cover part
8 Bellows
9 to 14 Insulating material housing parts/ceramic cylinders
15 Metallic housing part
16 First insulating material housing area
17 Second insulating material housing area
18 to 25 Vapor shields or field control elements
$L_1$ Length of the insulating material housing parts 9 and 12
$L_2$ Length of the insulating material housing parts 10 and 13
$L_3$ Length of the insulating material housing parts 11 and 14
S Center plane/axis of symmetry

The invention claimed is:

1. A vacuum interrupter, comprising:

a housing having two insulating material housing areas disposed and constructed symmetrically relative to a center plane;

each of said two insulating material housing areas having a plurality of insulating material housing parts with lengths;

said insulating material housing parts including an insulating material housing part disposed furthest away from the center plane and other insulating material housing parts disposed closer to the center plane;

said length of said insulating material housing part disposed furthest away from the center plane in each of said insulating material housing areas being greater than said length of said other insulating material housing parts; and said lengths of said other insulating material housing parts being calculated from said length of said insulating material housing part disposed furthest away from the center plane using the formula:

$$L(x) \geq p(x) \cdot L_N$$

-continued where $$p(x) \cong \frac{(2x-1)}{(2N-1)}$$

L=said length of one of said other insulating material housing parts;

N=a total number of said insulating material housing parts of the vacuum interrupter;

$$N-1 \ \ldots \ \frac{N}{2}+1.$$

2. The vacuum interrupter according to claim 1, wherein said lengths of said other insulating material housing parts decrease with decreasing distance from the center plane.

3. The vacuum interrupter according to claim 1, which further comprises at least one of vapor shields or field control elements mounted between said insulating material housing parts.

4. The vacuum interrupter according to claim 1, which further comprises a metallic housing part disposed between said insulating material housing areas.

* * * * *